US005743540A

United States Patent [19]

Wilhelm, III

[11] Patent Number: 5,743,540

[45] Date of Patent: Apr. 28, 1998

[54] IN-LINE ROLLER SKATE BRAKE SYSTEM

[76] Inventor: Donald Wilhelm, III, 1918 Marguerite Ave., Pleasant Hill, Calif. 94523

[21] Appl. No.: 631,698

[22] Filed: Apr. 9, 1996

[51] Int. Cl.[6] ..... A63C 17/14

[52] U.S. Cl. ..... 280/11.2; 188/5

[58] Field of Search ..... 280/11.2, 11.19, 280/11.22, 11.23, 11.27, 87.042; 188/5, 6, 250 B, 250 E

[56] References Cited

U.S. PATENT DOCUMENTS

| | | | |
|---|---|---|---|
| 4,512,590 | 4/1985 | Stenvall | 280/11.23 |
| 5,183,276 | 2/1993 | Pratt | 280/11.22 |
| 5,308,093 | 5/1994 | Walin | 280/11.2 |
| 5,316,325 | 5/1994 | Mitchell et al. . | |
| 5,320,367 | 6/1994 | Landis . | |
| 5,330,207 | 7/1994 | Mitchell . | |
| 5,340,131 | 8/1994 | Smathers et al. . | |
| 5,374,071 | 12/1994 | Johnson . | |
| 5,401,038 | 3/1995 | Peck et al. . | |
| 5,411,276 | 5/1995 | Moldenhauer . | |
| 5,439,238 | 8/1995 | Neal . | |
| 5,487,552 | 1/1996 | Daoust | 280/11.2 |
| 5,527,049 | 6/1996 | Ortiz | 280/11.2 |
| 5,570,759 | 11/1996 | Zorzi | 188/5 |
| 5,584,491 | 12/1996 | Kronyak, Jr. | 280/11.2 |
| 5,630,595 | 5/1997 | Perner | 280/11.2 |
| 5,647,599 | 7/1997 | Visger et al. | 280/11.2 |
| 5,653,454 | 8/1997 | Chin | 280/11.2 |
| 5,655,783 | 8/1997 | Brosnan | 280/11.2 |
| 5,664,794 | 9/1997 | Mitchell et al. | 280/11.2 |

*Primary Examiner*—Brian L. Johnson
*Assistant Examiner*—Bridget Avery
*Attorney, Agent, or Firm*—Thomas R. Lampe

[57] ABSTRACT

A braking system for an in-line roller skate includes a brake actuator arm pivotally mounted on a support shaft extending through the rearmost wheel of the skate. Brake pads are connected to a first segment of the brake actuator arm and extend behind the rear wheel. The brake actuator arm is continuously biased to maintain the brake pads, which are tire segments, out of engagement with the skate support surface. An upwardly directed force applied to the brake actuator arm by the skater pivots the arm relative to the in-line roller skate and brings the brake pads into contact with the skate support surface.

14 Claims, 3 Drawing Sheets

IN-LINE ROLLER SKATE BRAKE SYSTEM

TECHNICAL FIELD

This invention relates to a brake system for use with in-line roller skates.

BACKGROUND ART

In-line roller skates have attained a high degree of popularity. Since such skates can attain high speeds and are often used on sidewalks, roads or other surfaces employed by pedestrians and vehicles, it is highly important to provide a braking system which is easily operable and highly effective to bring the skate to a controlled stop on short notice.

Conventionally, in-line roller skates have employed friction pads affixed to the skates, requiring the skater to place his or her foot in awkward orientations and positions to engage the pads with the skating surface when desiring to come to a stop.

In an attempt to overcome the deficiencies of such fixed pad arrangements, a number of approaches have been devised which employ mechanically actuated arrangements operated by the skater in some manner to move a brake pad relative to the skate in a relatively controlled manner. Such arrangements are often characterized by their complexity, relative ineffectiveness, and high expense.

A search relating to the present invention located the following patents which are believed to be representative of the present state of the art in this field: U.S. Pat. No. 5,316,325, issued May 31, 1994, U.S. Pat. No. 5,330,207, issued Jul. 19, 1994, U.S. Pat. No. 5,401,038, issued Mar. 28, 1995, U.S. Pat. No. 5,439,238, issued Aug. 8, 1995, U.S. Pat. No. 5,411,276, issued May 2, 1995, U.S. Pat. No. 5,374,071, issued Dec. 20, 1994, U.S. Pat. No. 5,340,131, issued Aug. 23, 1994 and U.S. Pat. No. 5,320,367, issued Jun. 14, 1994.

DISCLOSURE OF INVENTION

The present invention relates to a braking system for in-line roller skates which is characterized by its relative simplicity, reliability and effectiveness. The structure of the braking system is such that minimal frictional losses occur in the system upon actuation of the brake. Maximum braking forces are applied when braking as a result of a simple manual manipulation by the skater.

The braking system of the present invention can be utilized with portions of vehicle tires utilized as the brake pad elements. Use of such material not only is ecologically sound since it promotes recycling of tires but tire segments are also highly effective as a brake pad material.

The braking system also incorporates a feature which allows ready adjustment of the skate frame or housing relative to the rear in-line roller skate wheel.

The structural combination of the present invention includes an in-line roller skate having an elongated platform means with a front end and a back end for supporting a skater's foot. Frame means is connected to the elongated platform means. The in-line roller skate also includes a row of in-line skate wheels, including a rear wheel rotatably mounted on the frame means.

A rear wheel support extends through the rear wheel and through the frame means to rotatably support the rear wheel.

A brake actuator arm is pivotally mounted relative to the frame means, the brake actuator arm having a first arm segment pivotally connected to the rear wheel support and extending upwardly and rearwardly from the rear wheel support and a second arm segment connected to the first arm segment at a location on the first arm segment spaced from the rear wheel support.

The second arm segment extends forwardly from the first arm segment a substantial distance adjacent to and along the elongated platform means in the general direction of the front end of the elongated platform means and has a distal end adjacent to the front end of the elongated platform means.

A brake pad support is affixed to the first arm segment at a location spaced from the rear wheel support.

Brake pad means is supported by the brake pad support extending laterally from the first arm segment behind the rear wheel and extending downwardly from the brake pad support.

Biasing means is connected to the brake actuator arm biasing the brake actuator arm to maintain the brake pad means out of engagement with a skate support surface until sufficient upwardly directed force is applied to the brake actuator arm at or adjacent to the distal end of the second arm segment to overcome the bias exerted by the biasing means to pivot the brake actuator arm and bring the brake pad means into braking engagement with the skate support surface behind the in-line roller skate.

Other features, advantages, and objects of the present invention will become apparent with reference to the following description and accompanying drawings.

BEST MODE FOR CARRYING OUT THE INVENTION

Figure 1:
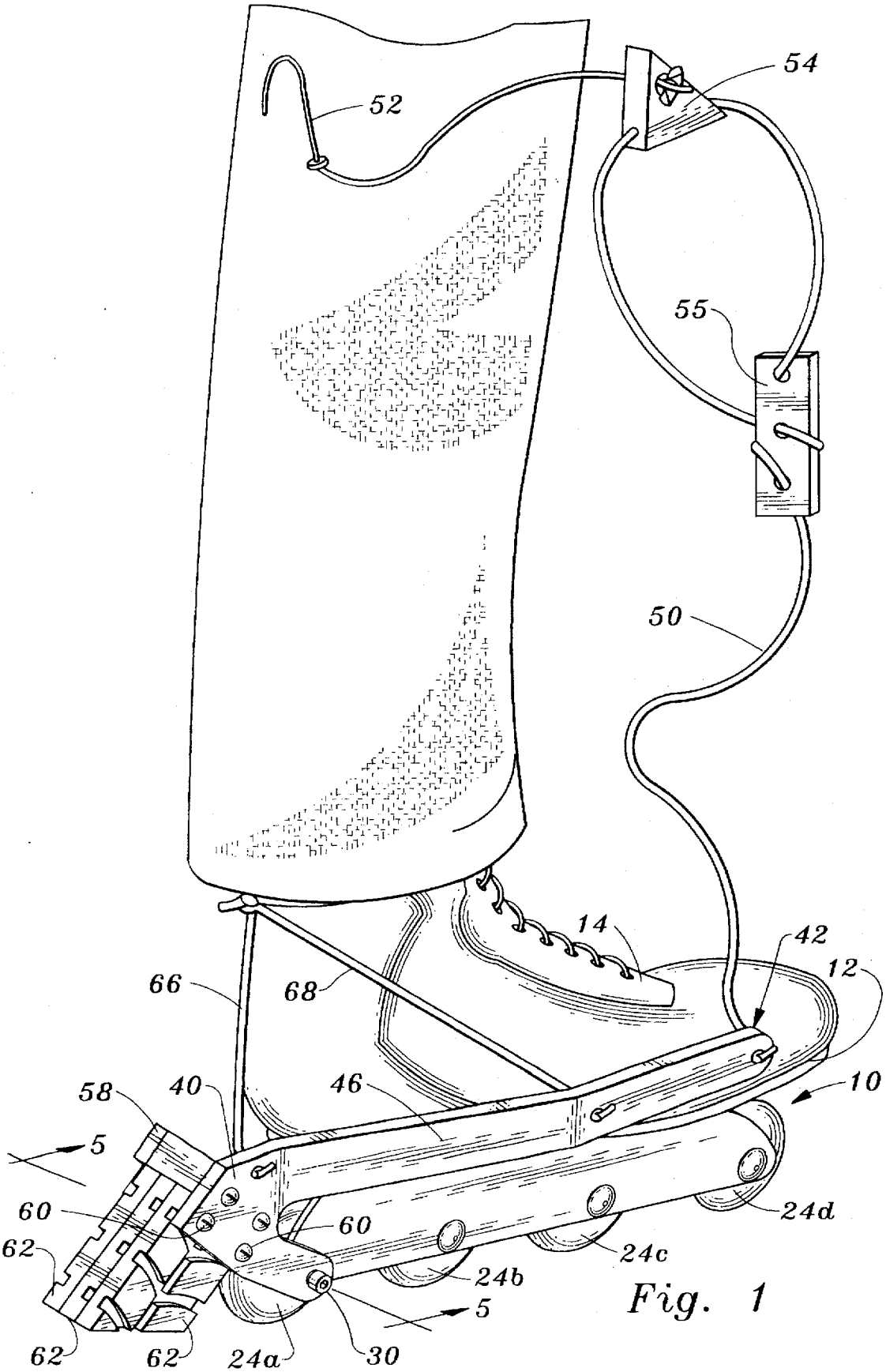
FIG. 1 is a perspective view of an in-line roller skate and brake system constructed in accordance with the teachings of the present invention illustrating the relationship thereof with a user's leg.
Figure 2:
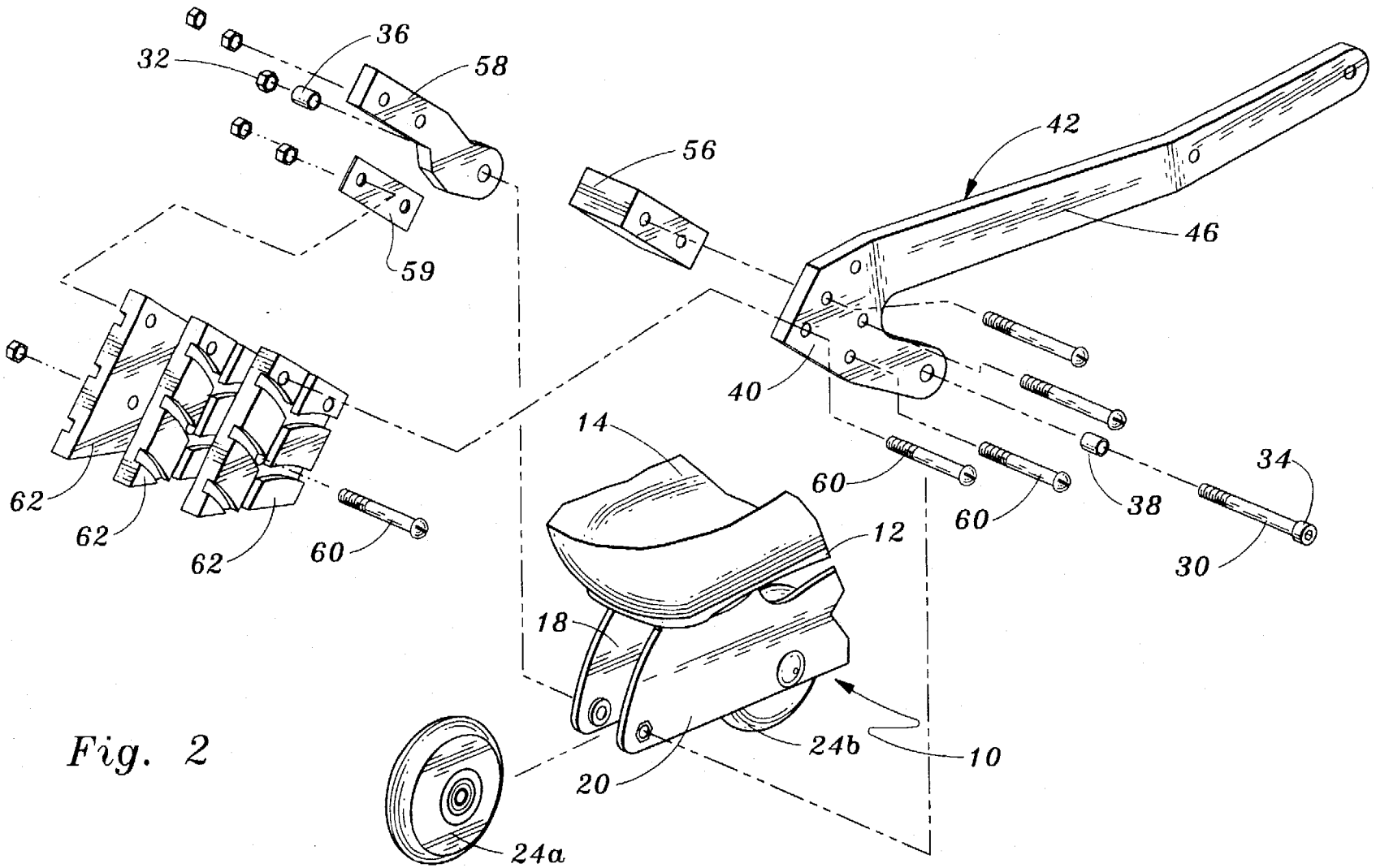
FIG. 2 is an exploded view illustrating a portion of an in-line roller skate and the components of the braking system of the present invention.

Referring now to the drawings, an in-line roller skate 10 is illustrated. Skate 10 includes an elongated platform 12, which in this instance is the sole portion of a boot or shoe 14. The platform 12 has a front end and a back end and is for the purpose of supporting a skater's foot.

A frame is connected to the platform 12. The frame includes two frame walls 18, 20 formed of metal, plastic or any other suitable material. The frame walls extend along the elongated platform 12 and project downwardly therefrom to define a space therebetween accommodating in-line roller skate wheels **24*a* through 24*d*, wheel 24*a*** being the rearmost wheel.

Wheels **24*b*, 24*c* and 24*d* are supported on frame walls 18, 20** with conventional stub axles (not shown). Rear wheel 24*a*, on the other hand, is supported by a rear wheel support. In the disclosed embodiment, the rear wheel support is in the form of a rear wheel support shaft 30 having an enlarged head 34 at one end thereof and a nut 32 threaded at the other end thereof. The illustrated enlarged head of the support shaft defines a socket to facilitate tightening or loosening the support shaft relative to nut 32. It will be appreciated that the principles of the present invention are applicable to other types of wheel supports. For example, it is known in the art to employ an in-line wheel support in the form of a threaded member disposed in the wheel and two screws threadedly secured thereto at opposed ends.

Support shaft 30 extends through opposed openings formed in frame walls 18, 20, the walls being of increased thickness at the locations of the openings to provide added strength. The shaft 30 also extends through rear wheel 24*a* to provide rotatable support for such wheel.

Bushings 36, 38 are disposed about shaft 30 near the ends thereof.

Pivotally mounted relative to shaft 30 and extending about bushing 38 is a first arm segment 40 of a brake actuator arm 42. The first arm segment 40 extends upwardly and rearwardly from the rear wheel support shaft.

The brake actuator arm 42 also includes a second arm segment 46 which is affixed to the first arm segment at a location on the first arm segment spaced from the rear wheel support shaft. The first and second arm segments may be integrally formed of molded plastic, metal or other suitable material.

Second arm segment 46 extends forwardly from the first arm segment a substantial distance adjacent to and along the elongated platform 12 in the general direction of the front end of the elongated platform. The second arm segment has a distal end adjacent to the front end of the elongated platform and may, for example, be in the order of ten or twelve inches in length to provide the desired mechanical advantage during operation of the braking system in a manner which will be described below.

The second arm segment is bent so that the distal end thereof is offset outwardly relative to the first arm segment away from the elongated platform so that the platform is properly cleared during operation of the braking system.

Figure 3:
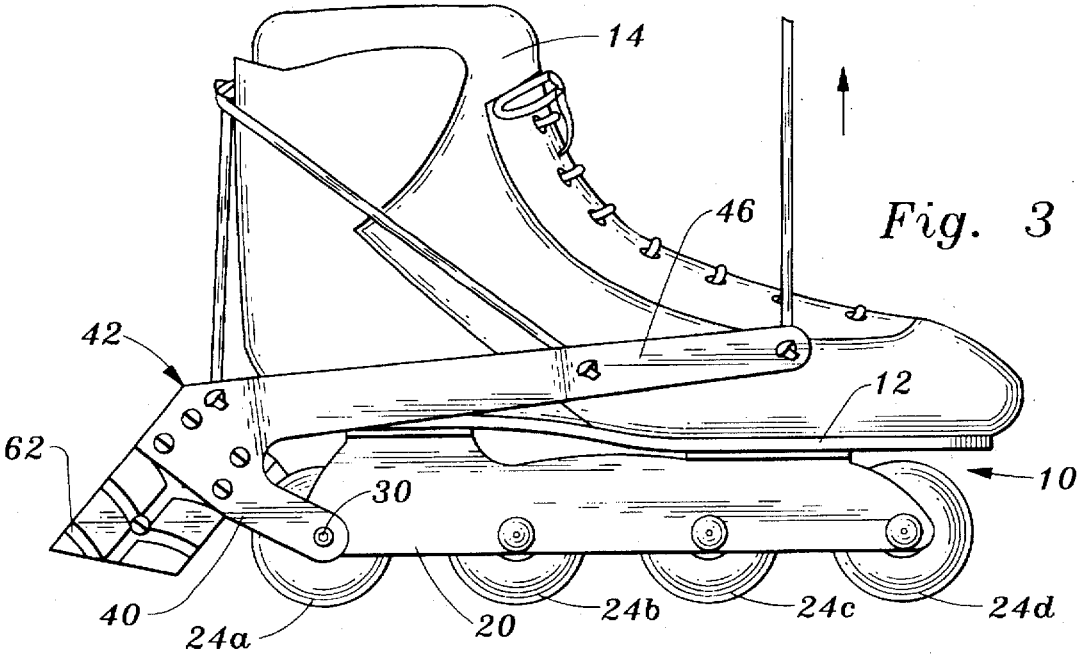
FIG. 3 is a side elevational view illustrating the in-line roller skate and associated braking system and the brake pad of the braking system in a position where it does not engage the skate support surface to effect braking.
Figure 4:
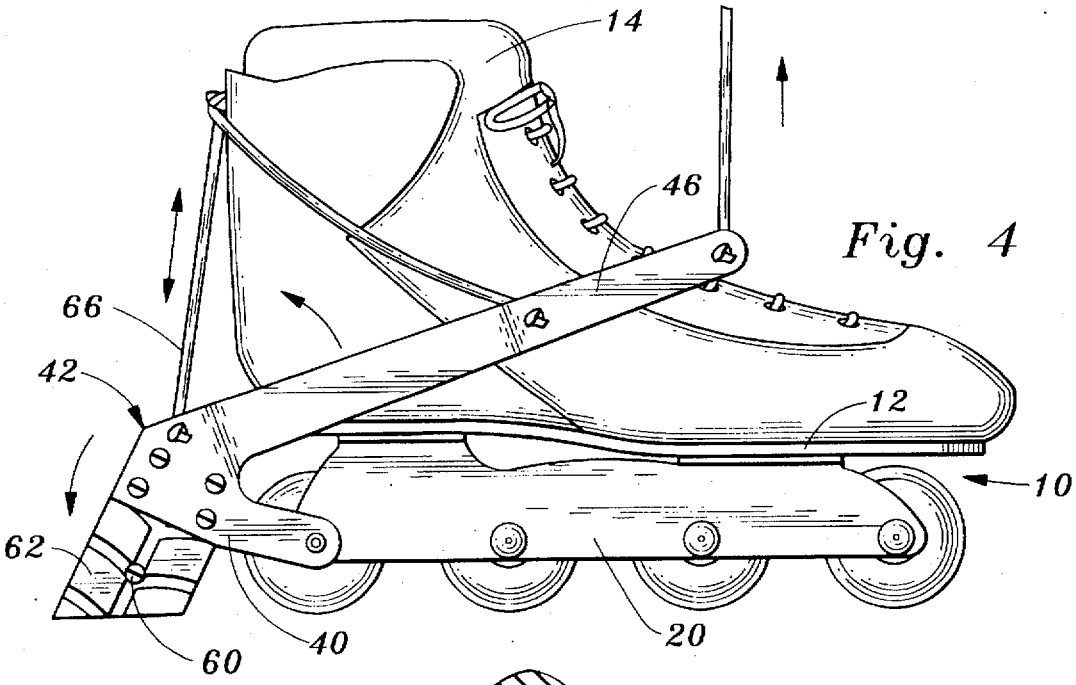
FIG. 4 is a view similar to FIG. 3, but illustrating the positions assumed by the structural elements of the braking system when manual force has been applied to the braking system to bring the brake pad into skate support surface engagement or braking position.
Figure 5:
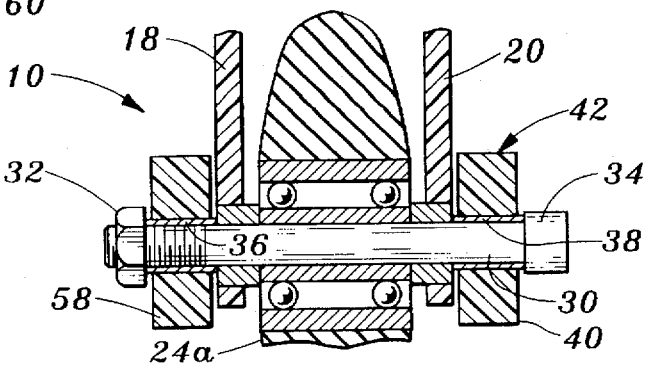
FIG. 5 is an enlarged sectional view taken along the line 5—5 of FIG. 1.

A cord 50 is attached to the distal end of the second arm segment for use by the skater when pulling the second arm segment distal end upwardly to rotate the brake actuator arm counter clockwise about support shaft 30 as viewed in FIGS. 3 and 4. A hook 52 may be deployed at the end of the cord to provide securement to the skater's apparel and suitable adjustment members 54, 55 may be employed to vary the operative length of the cord as well as the configuration thereof.

Connected to first arm segment 40 by two sets of threadedly engaged nuts and bolts is a spacer block 56 which is disposed between and in abutting engagement with the first arm segment 40 and a support arm 58 also rotatably mounted about rear wheel support shaft 30. Bushing 36 passes through support arm 58 and is disposed about support shaft 30. The support arm 58 is therefore locked for movement with brake actuator arm 42 when the brake actuator arm is pivoted. If desired, spacer block 56 and support arm 58 may be integral with brake actuator arm 42, being, for example, integrally molded therewith from plastic or fabricated from metal or other suitable material.

Positioned immediately below spacer block 56 and supported by a brake pad support in the form of threaded bolts 60 is brake pad means comprising three cut segments of automotive tires. These brake pad segments are identified by reference numeral 62. The lower most ends of the brake pad segments are cut on a bias. The threaded bolts 60 pass through corresponding holes formed in the brake pad segments, a retainer plate 59, and nuts which are threadedly engaged with the threaded ends of the bolts to secure the brake pad segments in place. The bolts 60 and brake pad segments extend laterally from the first arm segment behind the rear wheel 24*a* and the brake pads segments extend downwardly from the brake pad support bolts.

Attached to first arm segment 40 of brake actuator arm 42 is a resilient cord 66 which continuously exerts an upward bias on the first arm segment to continuously urge the brake actuator arm to the position shown in FIGS. 1 and 3. In the arrangement illustrated, the other end of the resilient cord 66 is attached to the boot near the top thereof. From this same attachment point a non-resilient cord 68 extends downward and forward, being attached at its other end to the forward portion of the brake actuator arm. This will limit the downward travel of the forward portion of the brake actuator arm.

With the arrangement illustrated, the in-line skate 10 can be brought to a controlled stop in an effective manner merely by the skater pulling upwardly on cord 50 to pivot the brake actuator arm 42 from the position shown in FIG. 3 to that shown in FIG. 4. This causes resilient cord 66 to stretch and the bias cut bottom surfaces of the brake pad segments to engage the ground or other skate supporting surface.

Considerable mechanical advantage results due to the elongated nature of the second arm segment 46 as compared to the length of first arm segment 40. The support arm 58 promotes structural stability of the mechanism, particularly during the braking operation. Tire rubber employed as the brake pad material provides a tough, highly effective gripping material for engaging the ground. This is especially true where steel belted tire sections are employed as the brake pad material. The steel belt elements also provide for increased pad strength at the location of the mounting bolts.

The bushings or sleeves 36, 38 allow the skater to adjust the distance between the frame walls 18, 20 and the rear wheel 24*a* to ensure stable and proper function of the skate at that critical location. Adjustment between the frame walls and the rear wheel is readily effected by tightening or loosening the nut 32 relative to the rear wheel support shaft 30. Tightening of the nut 32 will cause the nut and the opposed enlarged head of the support shaft 30 to bear against the bushings or sleeves which in turn move the frame walls 18, 20 toward the rear skate wheel. Loosening of the nut 32 will, of course, have the opposite effect. The brake pad support in the form of threaded bolts 60 and their respective cooperable nuts allows pads of different widths and different numbers of pads to be employed if desired since the nuts can readily be adjusted to modify the effective length of the bolts.

I claim:

1. In combination:

an in-line roller skate including elongated platform means having a front end and a back end for supporting a skater's foot, frame means connected to said elongated platform means, extending along said elongated platform means, and projecting downwardly from said elongated platform means, and a row of in-line wheels, including a rear wheel rotatably mounted on said frame means;

a rear wheel support extending through said rear wheel and through said frame means rotatably supporting said rear wheel;

a brake actuator arm pivotally mounted relative to said frame means, said brake actuator arm having a first arm segment pivotally connected to said rear wheel support and extending upwardly and rearwardly from said rear wheel support and a second arm segment connected to said first arm segment at a location on said first arm segment spaced from said rear wheel support, said second arm segment extending forwardly from said first arm segment a substantial distance adjacent to and along said elongated platform means in the general direction of the front end of said elongated platform means and having a distal end adjacent to the front end of said elongated platform means;

a brake pad support affixed to said first arm segment at a location spaced from said rear wheel support;

brake pad means supported by said brake paid support extending laterally from said first arm segment behind said rear wheel and extending downwardly from said brake pad support;

biasing means connected to said brake actuator arm biasing said brake actuator arm to maintain said brake pad means out of engagement with a skate support surface until sufficient upwardly directed force is applied to said brake actuator arm at or adjacent to the distal end of said second arm segment to overcome the bias exerted by said biasing means to pivot said brake actuator arm and bring said brake pad means into braking engagement with the skate support surface behind said in-line roller skate; and a support arm pivotally connected to said rear wheel support at a location spaced from said brake actuator arm, said support arm being fixedly attached to said brake pad support.

2. The combination according to claim 1 wherein said frame means includes two frame walls spaced apart and defining a space therebetween accommodating said rear wheel and wherein said rear wheel support extends through said frame walls and retains said rear wheel support on said frame walls.

3. The combination according to claim 1 including first and second bushings extending about said rear wheel support at spaced locations thereon, one of said bushings extending through said brake actuator arm and the other of said bushings extending through said support arm.

4. The combination according to claim 1 wherein said brake pad support includes adjustment means to accommodate brake pad means of different sizes.

5. The combination according to claim 1 additionally comprising an elongated flexible pull member attached to the distal end of the second arm segment.

6. The combination according to claim 1 wherein said biasing means comprises an elongated, flexible resilient cord.

7. The combination according to claim 2 including means cooperable with said frame walls responsive to movement of said rear wheel support to move at least one of said frame walls relative to said rear wheel.

8. The combination according to claim 7 wherein said means cooperable with said frame walls comprises bushing means extending about said rear wheel support and bearing against at least one of said frame walls.

9. The combination according to claim 8 wherein said bushing means extends through said first arm segment.

10. The combination according to claim 3 wherein said frame means include two frame walls, said frame walls being on opposite sides of said rear wheel, one of said bushings in abutting engagement with one of said frame walls and the other of said bushings in abutting engagement with the other of said frame walls, said bushings cooperable with said rear wheel support to move said frame walls relative to said rear wheel.

11. The combination according to claim 4 wherein said brake pad means comprises a plurality of adjoining brake pad segments.

12. The combination according to claim 11 wherein said brake pad segments comprise segments cut from tires.

13. In combination:

an in-line roller stake including elongated platform means having a front end and a back end for supporting a skater's foot, frame means connected to said elongated platform means, extending along said elongated platform means, and projecting downwardly from said elongated platform means, and a row of in-line wheels, including a rear wheel rotatably mounted on said frame means;

a rear wheel support extending through said rear wheel and through said frame means rotatably supporting said rear wheel;

a brake actuator arm pivotally mounted relative to said frame means, said brake actuator arm having a first arm segment pivotally connected to said rear wheel support and extending upwardly and rearwardly from said rear wheel support and a second arm segment connected to said first arm segment at a location on said first arm segment spaced from said rear wheel support, said second arm segment extending forwardly from said first arm segment a substantial distance adjacent to and along said elongated platform means in the general direction of the front end of said elongated platform means and having a distal end adjacent to the front end of said elongated platform means;

a brake pad support affixed to said first arm segment at a location spaced from said rear wheel support;

brake pad means supported by said brake pad support extending laterally from said first arm segment behind said rear wheel and extending downwardly from said brake pad support; and biasing means connected to said brake actuator arm biasing said brake actuator arm to maintain said brake pad means out of engagement with a skate support surface until sufficient upwardly directed force is applied to said brake actuator arm at or adjacent to the distal end of said second arm segment to overcome the bias exerted by said biasing means to pivot said brake actuator arm and bring said brake pad means into braking engagement with the skate support surface behind said in-line roller skate, said brake pad means defining at least one hole extending therethrough, said brake pad support including mechanical fastener means extending through said at least one hole.

14. In combination:

an in-line roller skate including elongated platform means having a front end and a back end for supporting a skater's foot, frame means connected to said elongated platform means, extending along said elongated platform means, and projecting downwardly from said elongated platform means, and a row of in-line wheels, including a rear wheel rotatably mounted on said frame means;

a rear wheel support extending through said rear wheel and through said frame means rotatably supporting said rear wheel;

a brake actuator arm pivotally mounted relative to said frame means, said brake actuator arm having a first arm segment pivotally connected to said rear wheel support and extending upwardly and rearwardly from said rear wheel support and a second arm segment connected to said first arm segment at a location on said first arm segment spaced from said rear wheel support, said second arm segment extending forwardly from said first arm segment a substantial distance adjacent to and along said elongated platform means in the general direction of the front end of said elongated platform means and having a distal end adjacent to the front end of said elongated platform means, the distal end of the second arm segment of the brake actuator arm being offset outwardly relative to said first arm segment away from said elongated platform means;

a brake pad support affixed to said first arm segment at a location spaced from said rear wheel support;

brake pad means supported by said brake pad support extending laterally from said first arm segment behind said rear wheel and extending downwardly from said brake pad support; and biasing means connected to said brake actuator arm biasing said brake actuator arm to maintain said brake pad means out of engagement with a skate support surface until sufficient upwardly directed force is applied to said brake actuator arm at or adjacent to the distal end of said second arm segment to overcome the bias exerted by said biasing means to pivot said brake actuator arm and bring said brake pad means into braking engagement with the skate support surface behind said in-line roller skate.

* * * * *